US006415499B1

(12) United States Patent
Holland et al.

(10) Patent No.: US 6,415,499 B1
(45) Date of Patent: Jul. 9, 2002

(54) COAXIAL CABLE STRIPPING AND CRIMPING TOOL

(75) Inventors: Michael Holland, Santa Barbara, CA (US); Yeh Min-Hua, Taipei (TW)

(73) Assignee: Holland Electronics, LLC, Ventura, CA (US)

( * ) Notice: Subject to any disclaimer, the term of this patent is extended or adjusted under 35 U.S.C. 154(b) by 0 days.

(21) Appl. No.: 09/675,378

(22) Filed: Sep. 29, 2000

(51) Int. Cl.[7] ..... H01R 43/042

(52) U.S. Cl. ..... 29/564.4; 29/566.4; 29/751; 72/409.14; 81/9.51

(58) Field of Search ..... 29/564.4, 33 M, 29/751, 753, 566.4, 761; 72/409.06, 416, 409.14; 81/9.51

(56) References Cited

U.S. PATENT DOCUMENTS 3,732,718 A * 5/1973 Barberio et al. ..... 72/410
4,660,241 A * 4/1987 Chen et al. ..... 29/566.4
5,211,049 A * 5/1993 Lucas ..... 29/751 X
6,053,025 A * 4/2000 Beetz et al. ..... 72/409.16

FOREIGN PATENT DOCUMENTS

DE 3825775 * 5/1989 ..... 29/564.4

* cited by examiner

*Primary Examiner*—William Briggs
(74) *Attorney, Agent, or Firm*—Michael G. Petit

(57) ABSTRACT

A tool for stripping the jacket, conductive braid and dielectric layer of a coaxial cable to the correct length required for attachment to a coaxial cable connector, and for attaching the stripped end of the coaxial cable to a coaxial cable connector by means of crimping. The stripping portion of the tool has a dual blade cutter that has preset blade separation, fixed cutting depths, and includes preset spring pressure to insure a complete cut. The tool further includes means for applying the force needed to hexagonally crimp a compression crimp ring having a length of up to ½ inch on a standard coaxial cable connector in order to attach the connector to the stripped cable. The invention provides an economical tool, and method for using the tool, for hex crimping a compression crimp ring of up to ½ inch in length on standard coaxial cable connectors. The tool uses a screw type mechanism to provide leverage for applying the required hexagonal compression force to facilitate proper installation of a cable connector on a cable, even by a non-professional cable installer.

3 Claims, 4 Drawing Sheets

COAXIAL CABLE STRIPPING AND CRIMPING TOOL

BACKGROUND OF THE INVENTION

1. Field of the Invention

The invention relates to coaxial cable connectors and, more particularly, to a tool for stripping a coaxial cable and for crimp attachment of the stripped coaxial cable to a coaxial cable connector.

2. Prior Art

In recent years, coaxial cables have been required to pass a wider spectrum of signals associated with communication systems such as, for example, Cable TV (CATV), Satellite TV, and off-air programming. Historically, these communication systems have been installed by professional installers who are well-trained and experienced people. Such professional installers employ specialized tools and standardized methods of cable connector installation to: (a) insure proper system performance; and (b) comply with new FCC RF-leakage requirements. Proper attachment of coaxial cable connectors to coaxial cables is required in order to accomplish both goals.

CATV system providers are required to bring their signal conducting cables only to the home entry point; thereby allowing the homeowner to select an independent contractor to wire the interior of his/her house. Alternatively, current regulations enable the homeowner to install the inside cable and connect the last distribution leg to the cable system himself/herself. In the case of satellite signals, the homeowner can install a downlink, or even an uplink, employing his/her choice of cable, cable connectors, preparation tools and methods. In the case of cable TV installations, the homeowner is responsible for preventing RF leakage and can have his/her CATV service terminated if the home installation causes RF signal leakage.

Inexpensive prior art cable stripping tools are available for the non-professional installer. Such tools employ a single blade or a knife blade to cut the insulating jacket, conductive braid, and dielectric material comprising the coaxial cable. The lack of cutting guides and controlled cutting pressure in such devices may result in the installer cutting through the braid, rendering use of the high-shielding braid "foldback" method for preparing the cable end for attachment to a connector impossible.

Present coaxial connectors that are intended for the do-it-yourself home installation market usually provide a cable connector attachment means consisting of a separate compression crimp ring, usually about ⅛ to ¼ inch in length, which is slipped over the cable-cable connector assembly and "crimped" (inelastically deformed inwardly) to effect attachment. The tool used for crimping is usually a pliers or an economy crimp tool with a circular hole in the crimping die. Upon crimping, the ¼ inch ring is pinched radially inwardly, forming an assembly wherein there is a relatively low retaining force between the prepared end of the cable and the terminal cable connector. The compressed (crimped) ring compresses the cable and the connector together at only 2 points underlying the portions of the compression ring that have been bent almost 90 degrees. Without sufficient holding force, connectors may partially pull off, causing RF leakage.

Prior art economical coaxial cable connector crimping tools lack a crimp die that can crimp a compression ring having a ½ inch or greater length and/or lack the means for applying the force required in order to compress the ½ inch ring to a hex form. Moreover, the Society of Cable Engineers has established standards for CATV and satellite TV connectors of 40 pounds holding force. Due to the large number of different coaxial cables used with connectors, consistent compliance with this standard is not possible without a longer crimp ring, such as a ½ inch crimp ring, and a hexagonal crimp. In addition, the performance standards for simple interior home TV extensions have increased dramatically. There remains a current need for a low cost coaxial cable stripping tool, in combination with a fastening (crimping) tool that may be used by an unskilled person for the leakproof installation of coaxial cable in the home.

SUMMARY

Present coaxial cable connection standards require the coaxial cable connector to include an integral crimp or compression ring that is at least ½ inch in length in order to provide the minimal level of holding force (40 pounds) and shielding necessary to prevent RF egress from occurring. Such a construction also provides a larger area for application of the force that holds the coaxial cable in attached relationship with the connector. The currently preferred crimp design is one of compressing the original round crimp ring into a hex form. This provides less stress on each of 6 points that have been bent.

Prior art hex pinch crimp tools, both amateur and professional, rely upon the leverage achieved by the length of a pliers type handle to compress the crimp ring. This tool, for handles of reasonable length, still requires great strength to in order to crimp a ring. The present invention creates the required hex compression force using a screw type mechanism. The benefit gained by ease of installation due to increased leverage more than offsets the slightly longer installation time required to affect the hex crimp.

It is a first object of the invention to provide an inexpensive coaxial cable installation tool having means for stripping the end of a coaxial cable in preparation for attachment of the cable to a coaxial cable connector and further includes cable attachment means operable for crimping the stripped end of the cable to the cable connector.

It is a further object of the invention to provide a tool for stripping the end of a coaxial cable in accordance with the above objective wherein the means for stripping comprises a dual blade cutter that has preset blade separation, fixed cutting depths, and preset spring pressure to insure a complete cut.

It is still a further object of the invention to provide an inexpensive coaxial cable installation tool meeting the above objectives wherein the cable attachment means is operable for hexagonally crimping a circular crimping ring on a coaxial cable connector.

It is yet a further object of the invention to provide an inexpensive coaxial cable installation tool meeting the above objectives wherein the cable attachment means is operable for hexagonally crimping a circular crimping ring on a coaxial cable connector that has a crimping ring length of up to one half inch.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
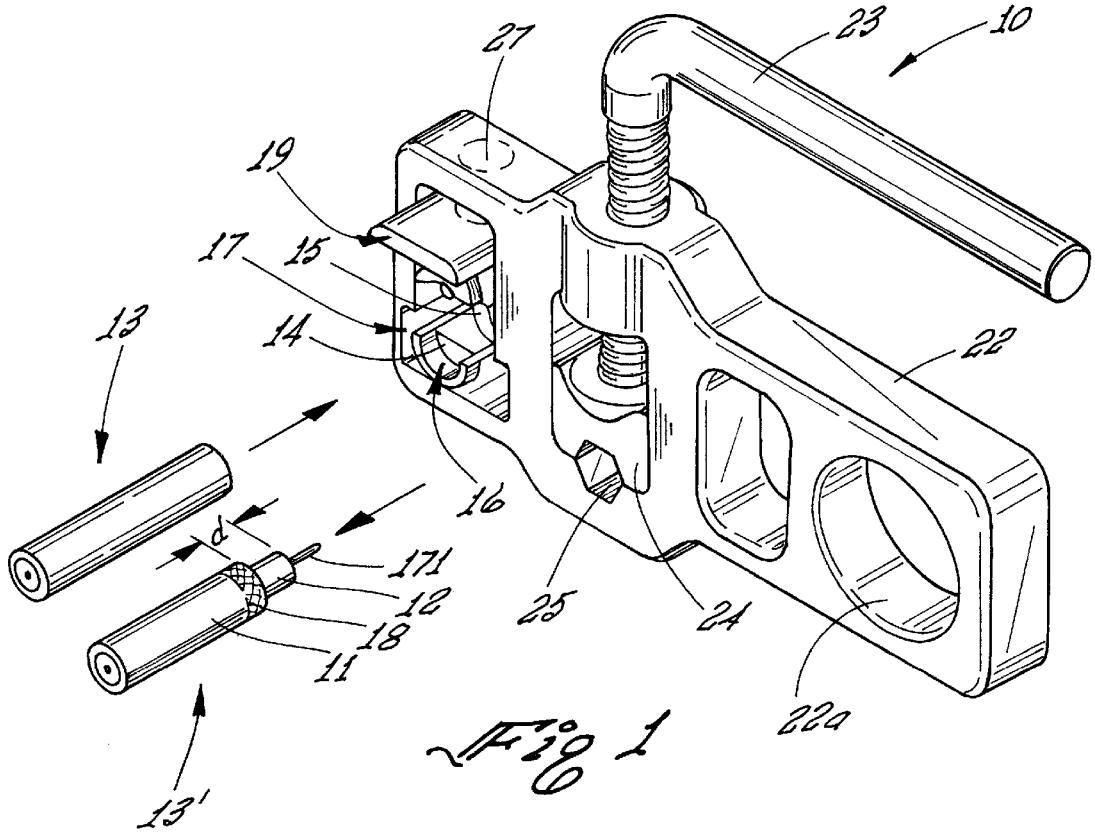
FIG. 1 is a perspective view of a preferred embodiment of a coaxial cable installation tool in accordance with the present invention.
Figure 2:
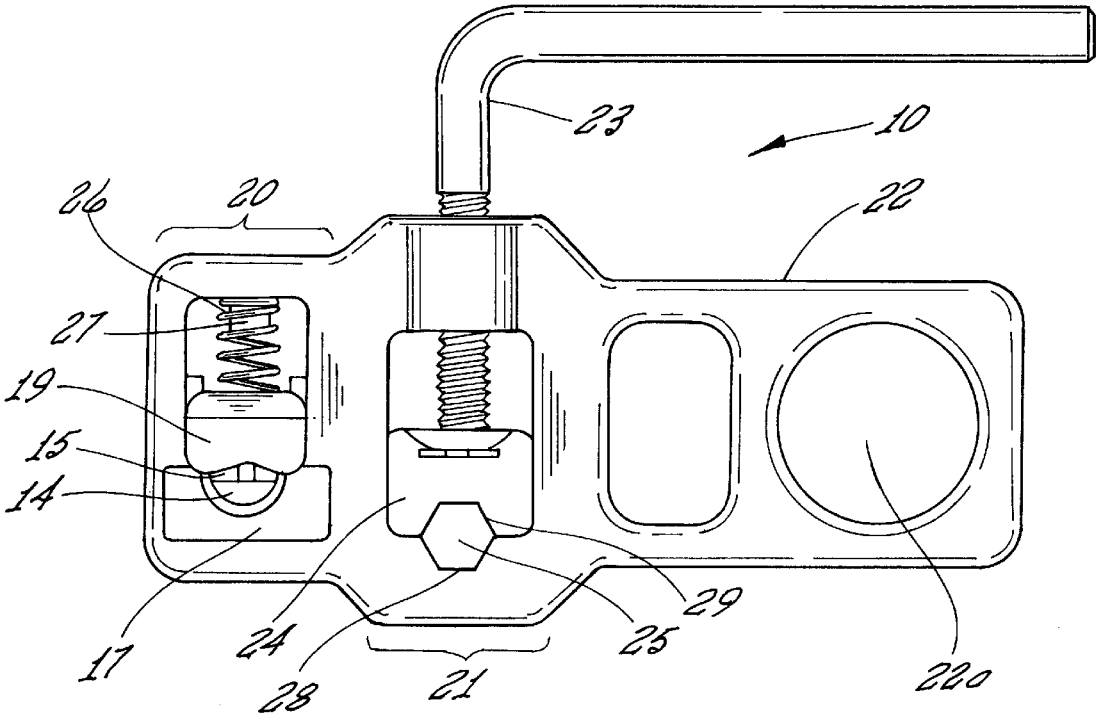
FIG. 2 is a front elevational view of the coaxial cable installation tool illustrated in FIG. 1.

A coaxial cable installation tool having integral construction in accordance with a preferred embodiment of the present invention is indicated in perspective and front elevational view at numeral 10 in FIGS. 1 and 2 respectively. The tool 10 comprises a stripping portion 20 and a crimping portion 21 supported by a unitary body member 22. The unitary body member 22 preferably has a circular aperture 22*a* therein that is dimensioned to receive a finger to facilitate rotating the tool 10. The stripping portion 20 of the tool 10 is operable for stripping a first length of jacket 11 and a second length of dielectric 12 from an end of a coaxial cable 13 in order to prepare the end of the cable 13 for attachment to a coaxial cable connector as shown at 13'. The crimping portion 21 is operable for deforming a coaxial cable connector's crimping ring, which has a circular cross-section (not shown), into a hexagonal cross-sectional shape.

The stripping portion 20 of the tool 10 has a jacket stripping blade 14 and a dielectric stripping blade 15 disposed in a blade holder 17 such that a cutting edge of each blade projects within a substantially cylindrical stripping cavity 16. The stripping cavity 16 into which the unprepared end of the coaxial cable 13 is inserted is formed conjointly by the blade holder 17 in juxtaposition with a spring-loaded slidably mounted cable holder 19. When the cable holder 19 is manually retracted from the blade holder 17, the cavity 16 is opened to permit insertion of an end of the cable 13 thereinto. When the retracted blade holder is released, a spring 26 interposed between the cable holder 18 and a body portion 22 of the tool, urges the cable facing surface of the cable holder against the cable to hold the cable within the cavity and force the cable against the cutting edge of the stripping blades 14 and 15. The tool 10 is then rotated about an axis that is coaxial with the cable axis and the blades cut through the jacket and dielectric layer. The cable is then withdrawn from the cavity; the end of the cable prepared for attachment to a coaxial cable connector, as shown at 13' in FIG. 1.

Figure 3:
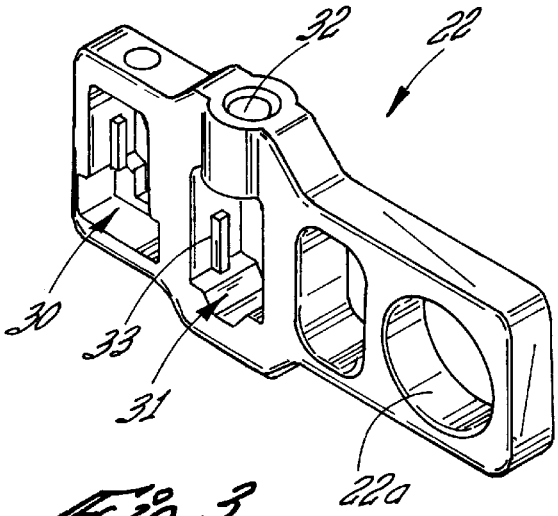
FIG. 3 is a front perspective view of the body portion of the cable installation tool shown in FIGS. 1 and 2.
Figure 4:
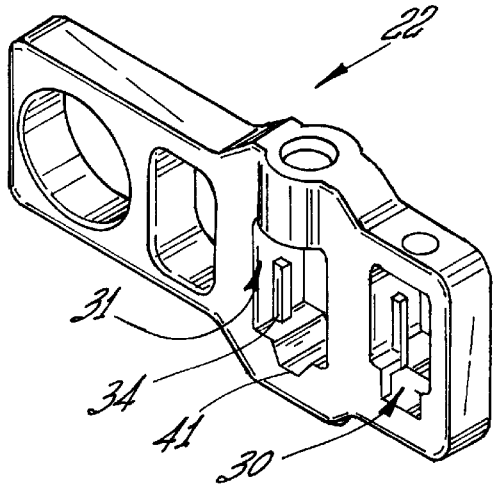
FIG. 4 is a rear perspective view of the body portion of the cable installation tool shown in FIGS. 1 and 2.

A unitary body member 22, as shown in front perspective view in FIG. 3 and rear perspective view in FIG. 4, includes cutouts 30 and 31 that support the operating portions of the tool 10, namely the stripping portion 20 and the crimping portion 21 respectively. The body member 22, which is preferably molded from a hard plastic, is unitary in construction and provides support for the cooperative elements comprising the aforementioned stripping and crimping portions of the tool. As mentioned earlier, a circular aperture 22*a* provides means for rotating the tool 10 about the stripping portion 20 with a finger thrust thereinto. One half of a hexagonal crimping die 25 is molded into the body member 22. The opposing half of the hexagonal crimping die 25 is molded into the slidably mounted die compression plate 24. A threaded screw 23 has a distal end that is rotatably attached to the compression plate 24. Rotation of the threaded screw advances (or retracts) the threaded screw through a threaded bore 32 in the body member thereby advancing (or retracting) the compression plate which, in turn, closes (or opens) the compression die 25. The crimping portion 21 of the tool is operable for forming a crimped attachment between a cable and a cable connector.

Figure 5:
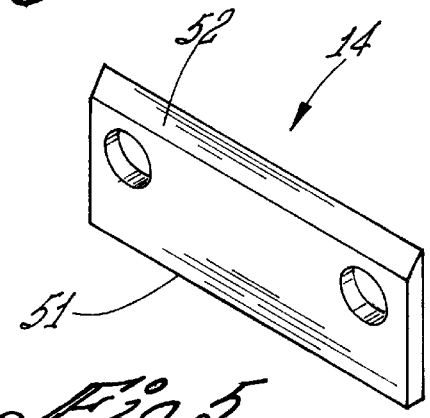
FIG. 5 is a perspective view of a jacket stripping blade operable for removing a portion of a coaxial cable jacket overlying the braided shielding.
Figure 6:
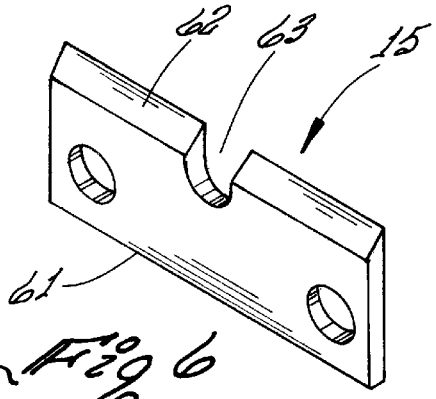
FIG. 6 is a perspective view of a dielectric. layer stripping blade operable for removing the portion of a coaxial cable overlying the central conductor.
Figure 7:
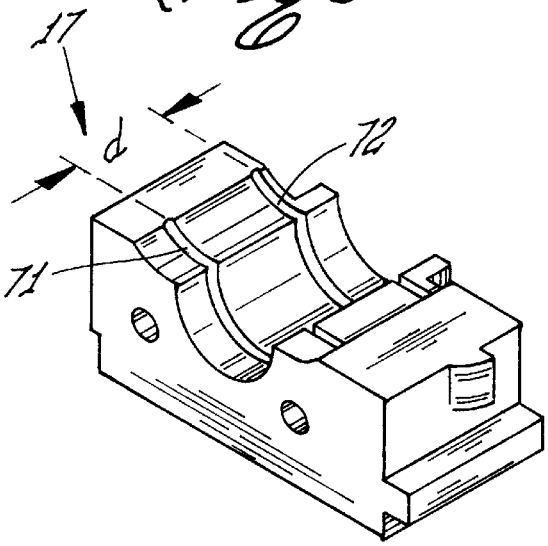
FIG. 7 is a front perspective view of a preferred embodiment of a blade holding member in accordance with the present invention.
Figure 8:
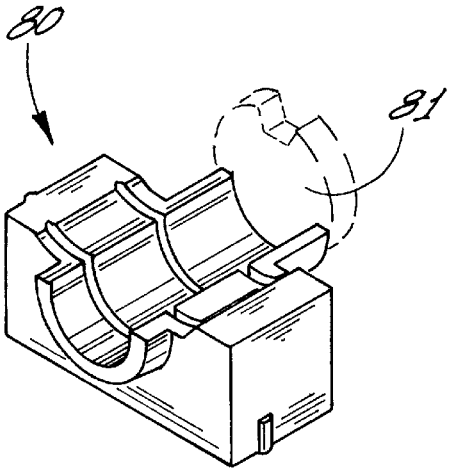
FIG. 8 is a front perspective view of a blade holding member in accordance with a second embodiment of the present invention, the embodiment illustrating a cable stop integral with the blade holding member.

Returning to the stripping portion 20 of the tool 10, two embodiments of a blade holder suitable for use with the tool of the present invention are illustrated in FIGS. 7 and 8. FIG. 7 shows a blade holder 17 having a jacket stripping blade slot 71 and a dielectric stripping blade slot 72 therein. The spacing d (FIGS. 1 and 7) between the slots is determined by the stripping requirements necessary for attaching a cable to a particular type of cable connector as is specified by the connector art. A base 51 of a jacket stripping blade 14, shown in perspective view in FIG. 5, is dimensioned to fit snugly within the jacket stripping blade slot 71 in the blade holder 17. The base 61 of the dielectric stripping blade 15, illustrated in perspective view in FIG. 6 is dimensioned to fit snugly within slot 72. The blade holder 17, with the blades 14 and 15 positioned and secured within their respective slots 71 and 72, is affixed to the cutout 30 in body member 22 by mechanical detent means, adhesive means, or by ultrasonic welding.

Figure 9:
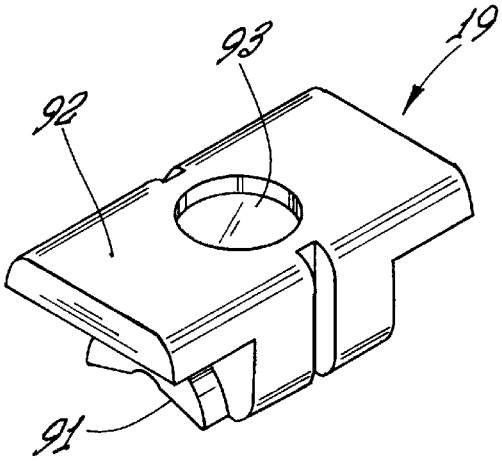
FIG. 9 is a top perspective view of a cable holding member in accordance with the present invention.
Figure 10:
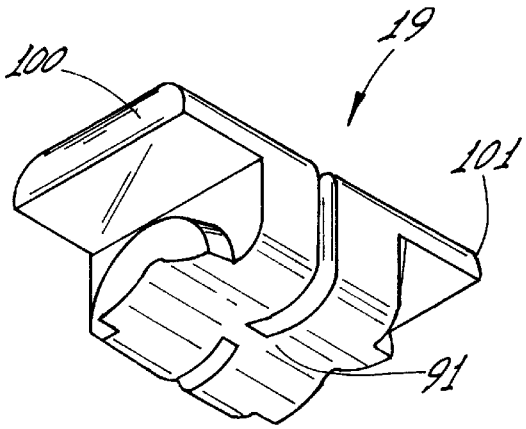
FIG. 10 is a bottom perspective view of the cable holding member illustrated in FIG. 9.
Figure 11:
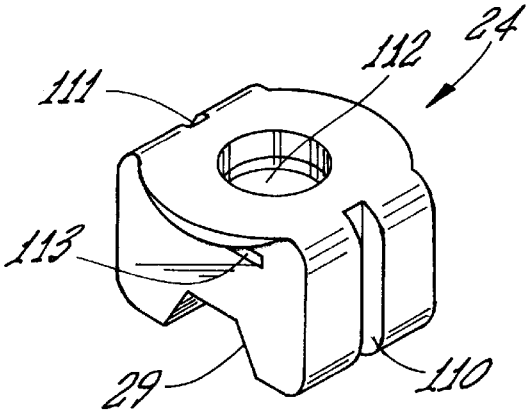
FIG. 11 is a top perspective view of the movable half of the hex crimp die in accordance with the present invention.
Figure 12:
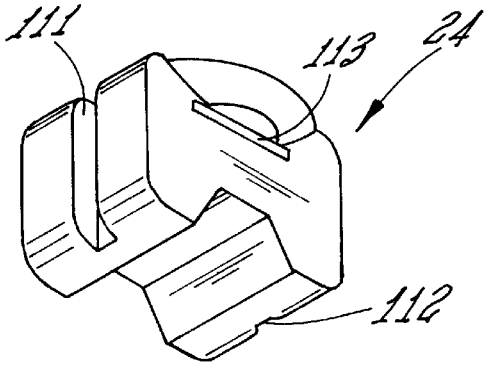
FIG. 12 is a bottom perspective view of the movable half of the hex crimp die illustrated in FIG. 11.
Figure 13:
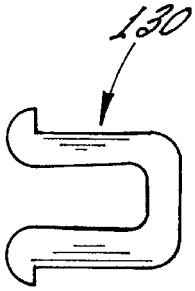
FIG. 13 is a top view of a screw retainer clip.

The cable holder 19, shown in top and bottom perspective views in FIGS. 9 and 10 respectively, comprises a. unitary plate having a concave lower surface 91 and an upper surface 92. A cylindrical recess 93 in the upper surface provides a retaining seat for one end of a coil spring 26 (shown in FIG. 2). The opposing end of the coil spring 26 rests against the body member 22 and is held in place by means of a spring retaining screw 72 (shown in FIG. 2). A pair of flanges 100 and 101 extend laterally from the compression plate 19. The flanges 100 and 101 provide means for an installer to manually grasp the compression plate 19 to compress the coil spring 26 in order to open the cavity 16 for the insertion (and removal) of the end of a cable into the cavity.

Figure 15:
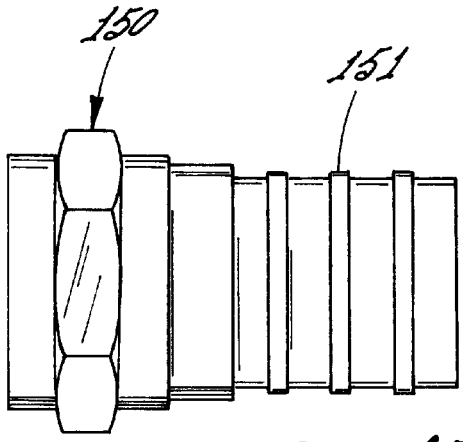
FIG. 15 is a side elevational view of a cable connector.
Figure 16:
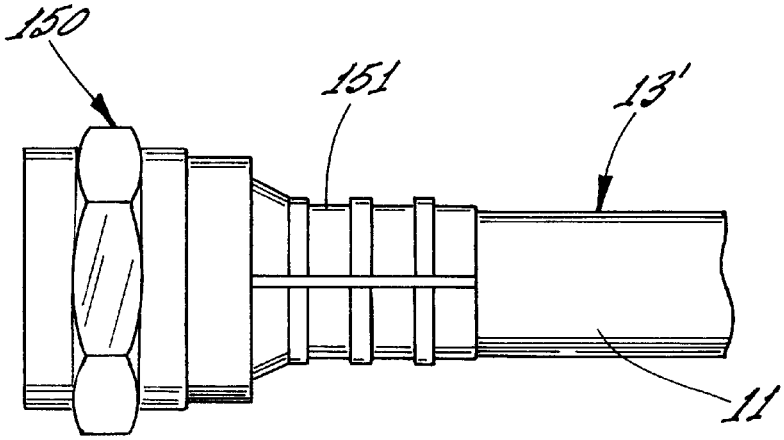
FIG. 16 is a side elevational view of a cable connector-cable assembly wherein the connector is attached to the cable by means of a hexagonally crimped ring.
Figure 17:
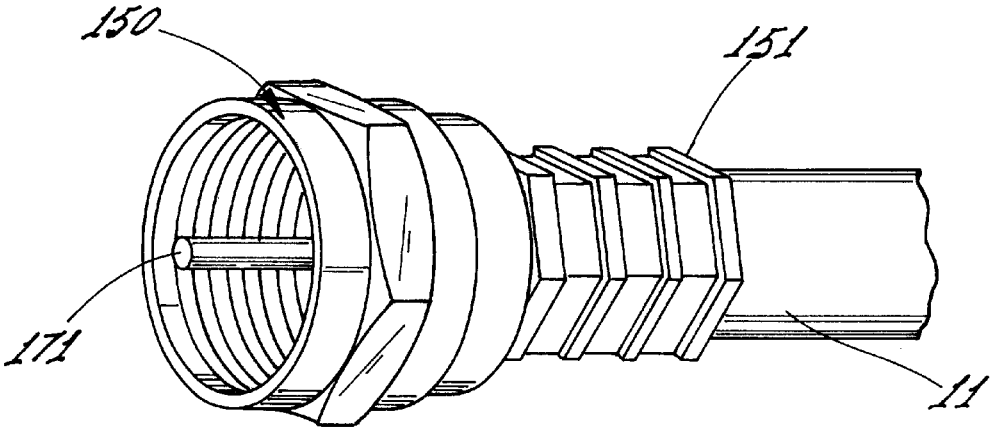
FIG. 17 is a perspective view of a cable connector-cable assembly as illustrated in FIG. 16 wherein the cable connector is attached to the cable by means of a hexagonally crimped ring.

Most, if not all, coaxial cable connectors intended for home installation have a crimp ring on a trailing end thereof that is operable for gripping a coaxial cable; thereby effecting the attachment of the connector to the prepared end of a coaxial cable. Such a cable-cable connector assembly is shown in longitudinal cross-sectional view in FIG. 15. With reference now to FIG. 15, The cable connector 150 includes a crimping ring 151 affixed to a trailing end thereof. In order to connect the prepared end of the coaxial cable 13' to the connector 150, the braided shielding 18 (See FIG. 1) of the cable 13 is folded back over the jacket 11 and the end of the cable 13' inserted into the trailing end of the connector 150 until the central conductor 171 of the cable is flush with the leading end of the connector 150 to form a loose (unattached) cable-cable connector assembly.

Figure 14:
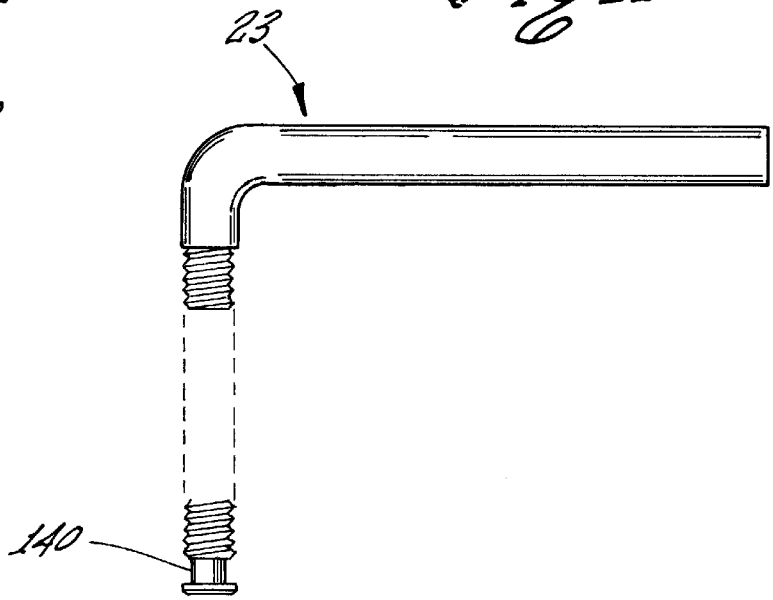
FIG. 14 is a side elevational view of a hex crimp die drive screw in accordance with the present invention.

Returning now to FIG. 2, the hexagonal crimping die 25 is comprised of a fixed half 28 which is molded into the body member 22 and a movable half 29 which is molded into the crimp compression plate 24. The crimp compression plate 24 is constrained to move in a direction that is perpendicular to the axis of the hexagonal die by means of grooves 110 and 111 which matingly and slidingly engage guide ribs 33 and 34 (FIGS. 3 and 4). The crimping screw 23 has an annular groove 140 on one end thereof as shown in FIG. 14. The end of the crimping screw 23 bearing the annular groove is inserted into a hole 112 in the compression plate and locked thereinto by a screw retaining clip 130 that is inserted into a slot 113 in the crimp compression plate 24. The screw retaining clip 130 engages the annular groove 140 in the crimping screw 23 and rotatably attaches the screw to the crimp compression plate. Rotation of the crimping screw 23 causes the crimp compression plate to advance toward the fixed half 28 of the hexagonal die 25 or retreat therefrom.

The loose cable-cable connector assembly is inserted into the cavity of the hexagonal die 25 within the crimping portion 21 of the tool with the crimping ring 151 disposed within the die cavity. Clockwise rotation of the screw 23 advances the crimp compression plate 24 toward the fixed half 28 of the hexagonal die until the two halves 28 and 29 are in juxtaposition. During compression, the circular crimping ring 151 is deformed to form a hexagon thereby gripping the cable jacket 11 and the (folded back) braided shielding 18. The leverage possible with screw driven compression reduces the force required to crimp the connector to the cable compared with the force required to operate a crimping device having plier-like compression.

While particular embodiments of the present invention have been illustrated and described, it would be obvious to those skilled in the art that various other changes and modifications can be made without departing from the spirit and scope of the invention. For example, the blade holder 17 may be further modified to include a jig stop 81, as shown in the blade holder 80 in FIG. 8. Such a jig stop serves to limit the length of cable that may be inserted into the stripping cavity. It is therefore intended to cover in the appended claims all such changes and modifications that are within the scope of this invention.

What we claim is:

1. A coaxial cable installation tool having integral construction comprising a body member supporting: (a) stripping means operable for stripping a first length of jacket and a second length of dielectric frown an end of a coaxial cable; and (b) crimping means operable for deforming a crimping ring having a circular cross section into a hexagonal cross-sectional shape wherein said stripping means comprises:

(i) a substantially cylindrical cavity having an axial direction, said cavity being dimensioned to receive said end of said coaxial cable and;

(ii) a blade holder supporting a first cutting blade and a second cutting blade, said first and second cutting blades projecting into said cavity in a direction perpendicular to said axial direction and being spaced a distance apart equal to the difference between said first length and said second length;

(iii) spring-loaded cable holding means operable for urging said end of said cable against said cutting blades when said end of said cable is in said cavity.

2. The coaxial cable installation tool of claim 1 wherein said crimping means comprises:

(a) a split die having a fixed portion, a movable portion and a cavity having a hexagonal cross-section therebetween; and (b) a screw operable for moving said movable portion of said split die with respect to said fixed portion.

3. The coaxial cable installation tool of claim 1 further comprising a circular aperture in said body member, said circular aperture being dimensioned to receive and loosely accommodate a finger inserted thereinto.

* * * * *